US007503715B2

(12) United States Patent
Khubani

(10) Patent No.: US 7,503,715 B2
(45) Date of Patent: Mar. 17, 2009

(54) SOAP DISPENSING ATTACHMENT FOR HAND-HELD APPLIANCE

(75) Inventor: Anand Khubani, Towaco, NJ (US)

(73) Assignee: Ideavillage Products, Corp., Wayne, NJ (US)

( * ) Notice: Subject to any disclaimer, the term of this patent is extended or adjusted under 35 U.S.C. 154(b) by 227 days.

(21) Appl. No.: 11/445,096

(22) Filed: Jun. 1, 2006

(65) Prior Publication Data

US 2006/0285910 A1 Dec. 21, 2006

Related U.S. Application Data

(60) Provisional application No. 60/691,819, filed on Jun. 17, 2005.

(51) Int. Cl.
*A46B 5/02* (2006.01)
*A46B 11/04* (2006.01)

(52) U.S. Cl. ..... 401/6; 401/205; 401/270

(58) Field of Classification Search ..... 401/6, 401/205, 270, 280, 281; 15/24, 32
See application file for complete search history.

(56) References Cited

U.S. PATENT DOCUMENTS 1,604,500 A * 10/1926 Tannenbaum ..... 15/29
3,554,485 A * 1/1971 Richards ..... 251/172
4,183,684 A 1/1980 Avery, Jr.
4,335,481 A * 6/1982 Slayman ..... 15/29
5,647,841 A 7/1997 Groenewold et al.
5,881,418 A 3/1999 Enoch
6,170,108 B1 1/2001 Knight
6,513,534 B1 * 2/2003 Sofer et al. ..... 132/112
2004/0265043 A1 12/2004 Palme

* cited by examiner

*Primary Examiner*—David J Walczak
(74) *Attorney, Agent, or Firm*—Robert L. Epstein; Epstein Drangel Bazerman & James, LLP

(57) ABSTRACT

The hand-held appliance includes an elongated handle connected to a head assembly. The head assembly has a motor-driven rotatable output shaft. The appliance is designed for use with a detachable cleansing unit that includes a housing. A fluid reservoir is situated within the housing. The cleansing unit is detachably connected to the output shaft. The unit also includes cleansing means. The fluid reservoir is connected to the cleansing means by a port such that fluid from the reservoir is dispensed from the cleansing means as the unit is rotated. The effective size of the port can be regulated to control the amount of fluid dispensed.

22 Claims, 3 Drawing Sheets

SOAP DISPENSING ATTACHMENT FOR HAND-HELD APPLIANCE

CROSS-REFERENCE TO RELATED APPLICATIONS

Priority is hereby claimed on Provisional Patent Application No. 60/691,819, filed Jun. 17, 2005, entitled "Soap Dispensing Attachment for Hand-Held Appliance.

STATEMENT REGARDING FEDERALLY SPONSORED RESEARCH OR DEVELOPMENT

Not Applicable

REFERENCE TO A "SEQUENCE LISTING", A TABLE, OR A COMPUTER PROGRAM LISTING APPENDIX SUBMITTED ON COMPACT DISC

Not Applicable

BACKGROUND OF THE INVENTION

1. Field of the Invention

This present invention relates to a hand-held, battery operated, appliance for use in the bath or shower of the type having interchangeable rotatable cleansing attachments and more particularly to a soap dispensing cleansing attachment for use with such an appliance.

2. DESCRIPTION OF PRIOR ART INCLUDING INFORMATION DISCLOSED UNDER 37 CFR 1.97 AND 1.98

Non-mechanical hand-held devices for dispensing fluids, such as cleansing agents, for example the device disclosed in U.S. Pat. No. 4,183,684 issued Jan. 15, 1980 to Avery, entitle "Fluid Dispensing Unit" are known in the art. The Avery device consists of a handle made of flexible material that houses a fluid reservoir. A porous pad is fixed to the underside of the handle. In order to dispense the fluid, the sides of the handle are squeezed forcing the fluid from the reservoir into the pad. However, that type of device does not have the capability of rotating the pad as the fluid is dispensed and therefore does not have the cleansing and massaging capabilities of a mechanical device.

Hand-held, electrically driven mechanical massaging and cleansing devices that are capable of rotating a scrubbing element such as a brush or pad are also known in the art. Some of those devices include fluid dispensing capability. For example, U.S. Pat. No. 5,647,841 issued Jul. 15, 1997 to Groenewald et al. and entitled "Motor-Driven Hand-Held Massaging Device" discloses apparatus for body massage with a plurality of rotating brushes carried on a housing with a grip part. The grip part has a storage chamber for massaging fluid that is fed to the individual brushes at controllable intervals.

U.S. Pat. No. 6,170,108 issued Jan. 9, 2001 to Knight entitled "Electric Back Scrubber Brush" discloses a device with an elongated handle and a head assembly including an electric motor for rotating a detachable brush head. The handle has a reservoir for soap that is dispended through a tube the end of which is situated adjacent the brush head.

Patent Application Publication No. 2004/0265043, published Dec. 30, 2004 entitled "Rotary Brush with Soap Dispenser" discloses a device similar to Knight in that it has a motor-driven brush assembly coupled to a handle but differs in that it is not portable because it is connected by a hose to receive water under pressure. In this device, the handle includes a compartment for a cleansing agent that is periodically delivered to the brush head by pumping action.

However, none of these devices includes a detachable rotating head with a porous cleansing pad attached to a housing having a fluid reservoir and means for controlling the amount of fluid dispensed at the head is rotated.

BREIF SUMMARY OF THE INVENTION

In accordance with one aspect of the present invention, a hand-held appliance is provided including an elongated handle connected to a head assembly. The head assembly has a motor-driven rotatable output shaft. The appliance also includes a detachable cleansing unit. The cleansing unit includes a housing. A fluid reservoir is situated within the housing. Means are provided for detachably connecting the housing to the output shaft. The unit also includes cleansing means. Means operably connect the fluid reservoir and the cleansing means such that fluid from the reservoir is dispensed from the cleansing means as the unit is rotated.

The cleansing means preferably takes the form of a porous pad, sponge or brush.

The unit also includes means for regulating the amount of fluid that is dispensed as the unit is rotated. The regulating means includes means for controlling the size of the fluid reservoir connecting means. The controlling means includes manually adjustable means.

The fluid connecting means includes a port between the reservoir and the cleansing means. The adjustable means is position adjustable to change the size of the port. The adjustable means includes spring means.

The unit also has a fluid entrance port connected to the reservoir. The housing is generally cylindrical and includes a side on which the fluid entrance port is located. A stopper for the fluid entrance port is provided as are means for connecting said stopper to said housing.

In accordance with another aspect of the present invention, a detachable cleansing unit is provided for use with a hand-held appliance of the type having an elongated handle connected to a head assembly with a motor-driven rotatable output shaft. The cleansing unit includes a housing. A fluid reservoir is provided within the housing. Means are provided for detachably connecting the housing to the output shaft. Cleansing means are provided, Means operably connect the fluid reservoir and the cleansing means such that fluid from the reservoir is dispensed from the cleansing means as the unit is rotated.

The cleansing means preferably takes the form of a porous pad, sponge or brush.

The unit also includes means for regulating the amount of fluid that is dispensed as the unit is rotated. The regulating means includes means for controlling the size of the fluid reservoir connecting means. The controlling means includes manually adjustable means.

The fluid connecting means includes a port between the reservoir and the cleansing means. The adjustable means is position adjustable to change the size of the port. The adjustable means includes spring means.

The unit also has a fluid entrance port connected to the reservoir. The housing is generally cylindrical and includes a side on which the fluid entrance port is located. A stopper for the fluid entrance port is provided, as are means for connecting said stopper to said housing.

BRIEF DESCRIPTION OF THE SEVERAL VIEWS OF DRAWINGS

To these and to such other objects that may hereinafter appears, the present invention relates to soap dispensing attachment for a hand-held appliance as described in detail in the following specification and recited in the annexed claims, taken together with the accompanying drawings, in which like numerals refer to like parts and in which:

DETAILED DESCRIPTION OF THE INVENTION

Figure 1:
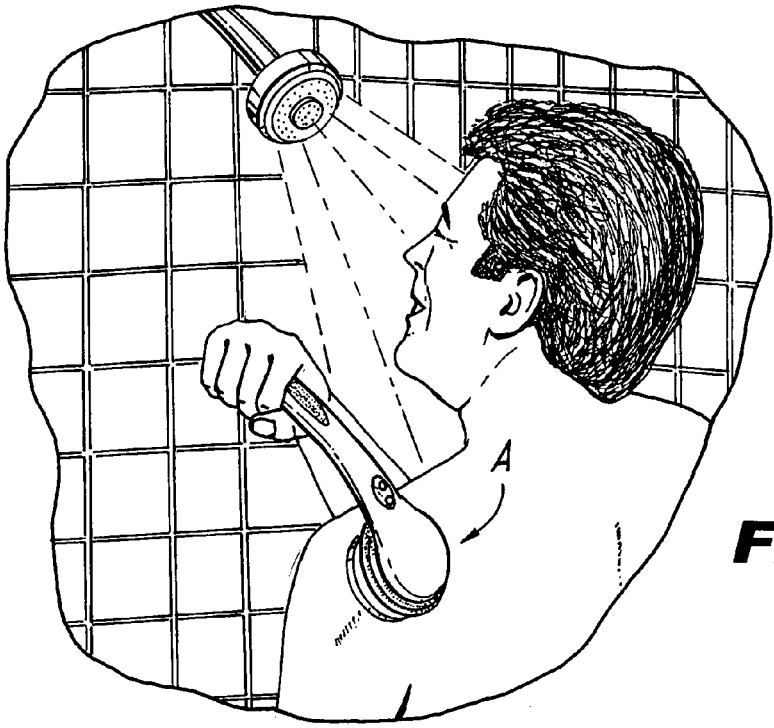
FIG. 1 is a view of a partial view of a man in a shower using the appliance with the cleansing unit of the present invention.
Figure 2:
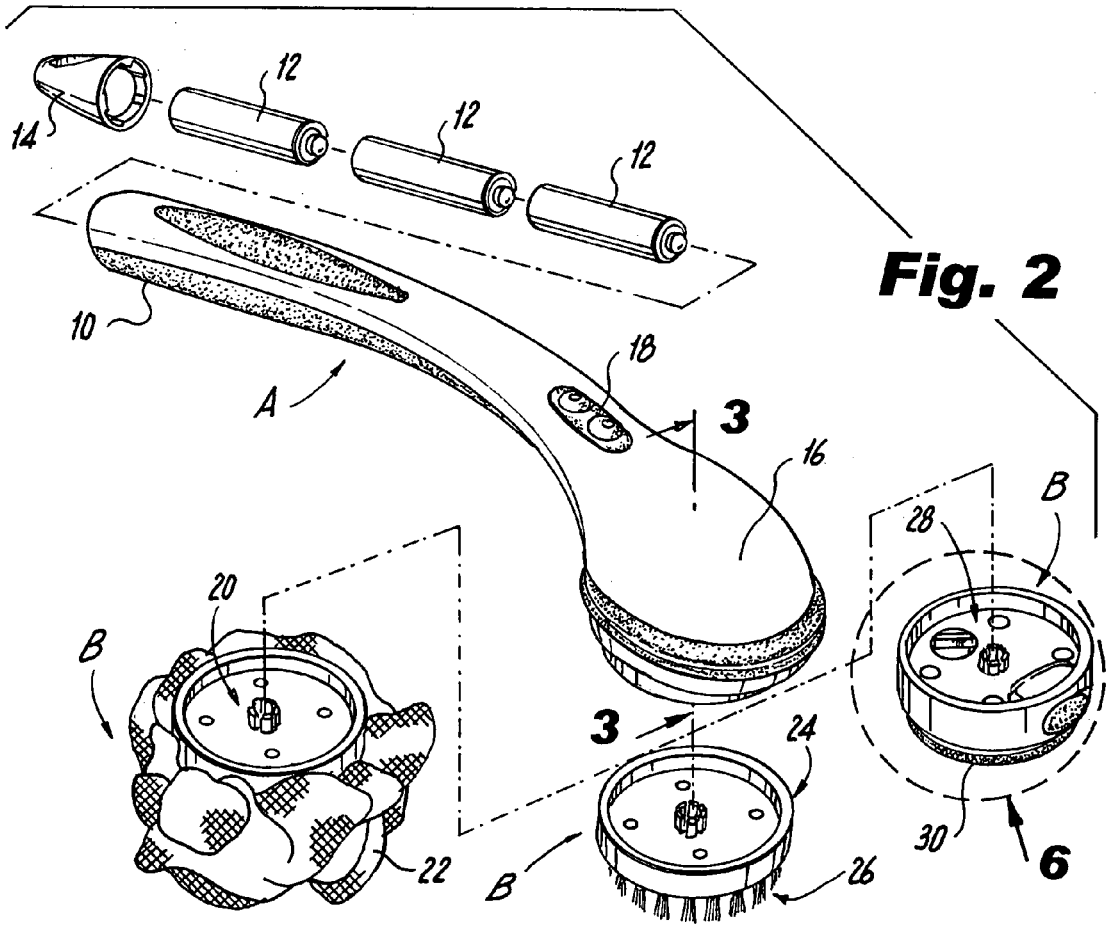
FIG. 2 is an exploded isometric view of the appliance and several detachable units, including the cleansing unit of the present invention.

FIG. 1 shows a man in a shower using the appliance, generally designated A. As better seen in FIG. 2, appliance A includes an elongated handle portion 10 defining a compartment for receiving a plurality of batteries 12 which are secured therein by an end cap 14. A head assembly 16 is situated on the front end of handle 10. A push button switch 18 is provided on the exterior surface of handle 10 to electrically connect an electric motor (not shown) located within head assembly 18 with batteries 12 to energize the motor.

Connectable to the bottom of head assembly 16 are a plurality of detachable cleansing units, generally designated B. Units B include a unit 20 with a sponge-like portion 22, a unit 24 which a brush portion 26 and a unit 28 with a porous pad 30 used for massaging, cleansing and the like.

Figure 3:
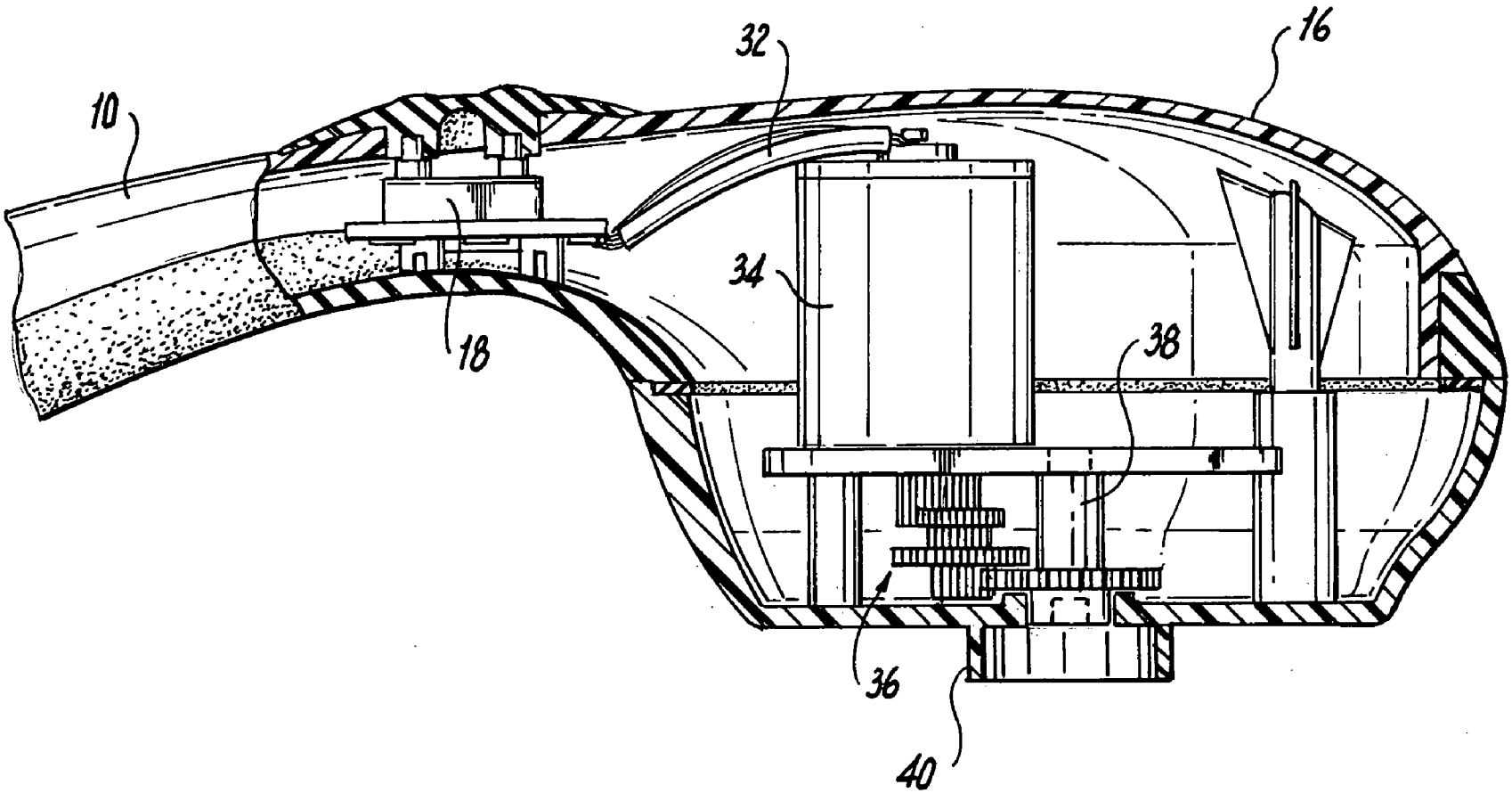
FIG. 3 is a cross-sectional view of the head assembly of the appliance.
Figure 4:
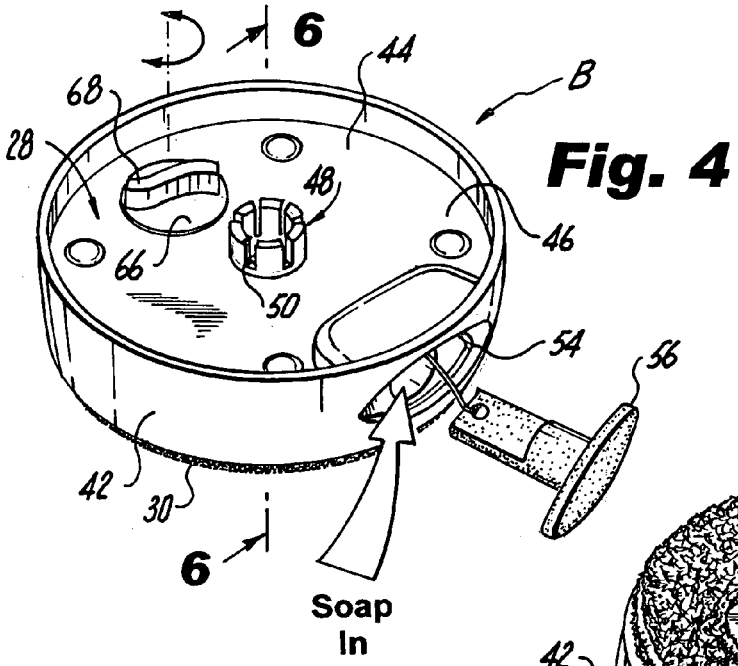
FIG. 4 is an isometric view of the top and side of the cleansing unit of the present invention with the fluid port stopper exploded.

FIG. 3 shows the inside of head assembly 16. Switch 18 is connected by wires 32 to an electric motor 34. The output shaft of motor 34 is connected by suitable gearing 36 to the rotatable output shaft 38 of the appliance. A hollow cylindrical connector 40 is fixed to the exposed end of shaft 38.

As seen in FIGS. 4-7, the cleansing unit 28 includes a generally cylindrical housing formed by a sidewall 42 which, along with surface 44 defines an open recess 46. Protruding from the middle of surface 44 is a connector 48 formed of a plurality of semi-rigid protrusions 50. Connector 48 is adapted to snap-fit into connector 40 of the head assembly of the appliance to detachably connect a selected one of the units B to the appliance for rotation with output shaft 38.

Figure 5:
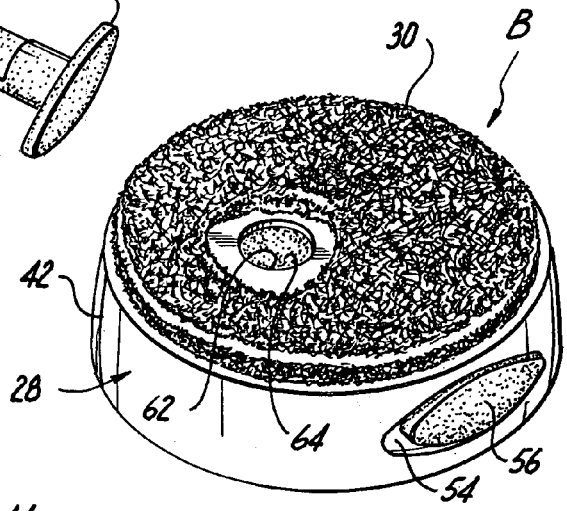
FIG. 5 is an isometric view showing the bottom (with a portion cut away to show the fluid connection port between the fluid reservoir and the cleansing pad) and side of the cleansing unit of the present invention.
Figure 6:
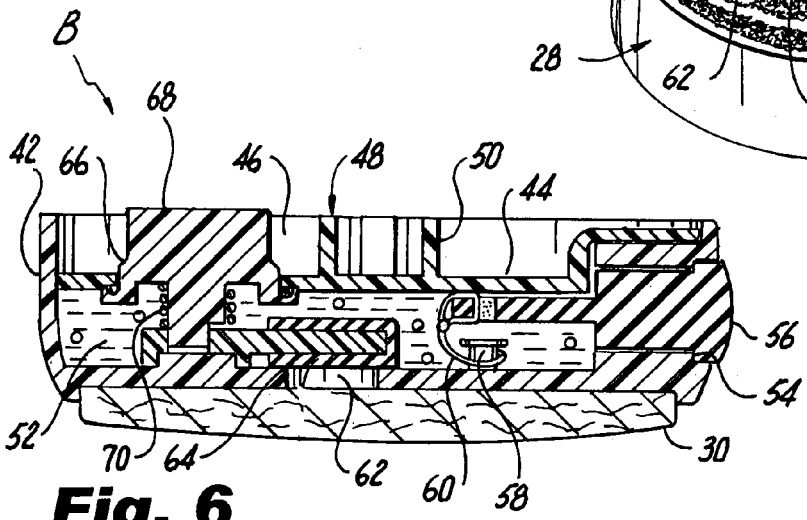
FIG. 6 is cross-sectional view of the cleansing unit of the present invention showing fluid connection port in the closed position.
Figure 7:
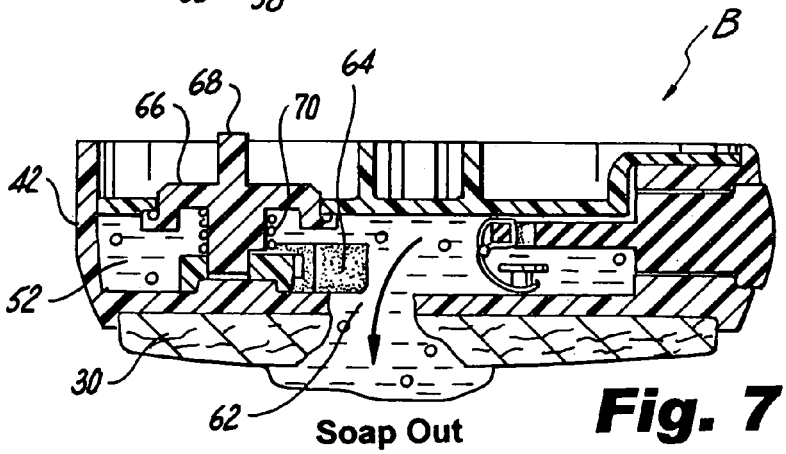
FIG. 7 is a view similar to FIG. 6 but showing the fluid connection port in the open position.

As best seen in FIGS. 5 and 6, located below surface 44 in cleansing unit 28 is a reservoir 52 for containing a fluid, such as liquid soap. A fluid entrance port 54 is formed in side 42 in order to permit reservoir 52 to be filled. A rubber stopper 56 is provided to seal port 54 after the reservoir is filled. Stopper 56 is attached to a pin 58 within reservoir 52 by a line 60 to prevent the stopper from being lost.

A fluid exit port 62 connects reservoir 52 and pad 30. A control member 64 is moveable relative to port 62 to open and close port 62, thereby regulating the size of the fluid connection between the reservoir and the pad and hence that amount of fluid that is dispensed as the unit is rotated.

Control member 64 is fixed on, and rotates with a rotatable control knob 66. Knob 66 has an upstanding "S" shaped part 68 to facilitate grasping thereof. Rotation of knob 66 opens and closes port 62. A spring 70 is provide to urge knob 66 toward surface 44 such that sufficient friction is developed to maintain the control knob in the rotational position in which it is set.

It will now be appreciated that the present invention relates to a detachable cleansing unit for use with a hand-held appliance of the type having an elongated handle connected to a head assembly with a motor-driven rotatable output shaft. The cleansing unit includes a cylindrical housing enclosing a fluid reservoir for containing soap or other cleansing liquid. A connector is provided for detachably connecting the housing to the output shaft of the motor. Cleansing means in the form of a porous pad or the like are provided. A size adjustable port connects the fluid reservoir and the cleansing means such that fluid from the reservoir is dispensed from the cleansing means as the unit is rotated. The port is adjusted by means of a rotatable control knob. A stopper is provided to seal the entrance port to the reservoir.

While only a single preferred embodiment of the present invention has been disclosed for purposes of illustration, it is obvious that many modifications and variations could be made thereto. It is intended to cover all of those modifications and variations which fall within the scope of the present invention, as defined by the following claims.

I claim:

1. A hand-held appliance comprising an elongated handle connected to a head assembly, said head assembly comprising a surface with an opening, a motor-driven rotatable output shaft, a first connector fixed to the end of said shaft and extending through said opening and beyond said surface, and a detachable cleansing unit, said cleansing unit comprising a generally cylindrical housing having a recess at least partially defined by a surface, a second connector extending within said housing recess outwardly from said recess surface for detachably engaging said first connector, a fluid reservoir within said housing, means for driving said output shaft to rotate said housing relative to said head assembly, cleansing means and means for operably connecting said fluid reservoir and said cleansing means such that fluid from said reservoir is dispensed from said cleansing means as said unit is rotated.

2. The appliance of claim 1 wherein said cleansing means comprises a porous pad.

3. The appliance of claim 1 further comprising means for regulating the amount of fluid that is dispensed as the unit is rotated.

4. The appliance of claim 3 wherein said regulating means comprises means for controlling the size of said fluid reservoir connecting means.

5. The appliance of claim 4 wherein said controlling means comprises manually adjustable means.

6. The appliance of claim 5 wherein said connecting means comprises a port between said reservoir and said cleaning means and wherein said adjustable means is position adjustable to change the size of said port.

7. The appliance of claim 5 wherein said adjustable means compnses spring means.

8. The appliance of claim 1 further comprising a fluid entrance port for said reservoir.

9. The appliance of claim 8 wherein said housing is generally cylindrical and includes a sidewall on which said fluid entrance port is located.

10. The appliance of claim 8 further comprising a stopper for said fluid entrance port.

11. The appliance of claim 10 further comprising means for connecting said stopper to said housing.

12. A detachable cleansing unit for use with a hand-held appliance of the type having an elongated handle connected to a head assembly with a motor-driven rotatable output shaft, said cleansing unit comprising a generally cylindrical housing having a recess at least partially defined by a first surface, a second surface facing in a direction opposite to said first surface, a fluid reservoir situated within said housing between said first and second surfaces, means for detachably connecting said housing to said output shaft, cleansing means mounted on and affixed to said second surface and means for operably connecting said fluid reservoir and said cleansing means such that fluid from said reservoir is dispensed from said cleansing means as said unit is rotated.

13. The unit of claim 12 wherein said cleansing means comprises a porous pad.

14. The unit of claim 12 further comprising means for regulating the amount of fluid that is dispensed as the unit is rotated.

15. The unit of claim 14 wherein said regulating means comprises means for controlling the size of said fluid reservoir connecting means.

16. The unit of claim 15 wherein said fluid reservoir controlling means comprises manually adjustable means.

17. The unit of claim 16 wherein said fluid reservoir connecting means comprises a port between said fluid reservoir and said cleansing means and wherein said adjustable means is position adjustable to change the size of said port.

18. The unit of claim 16 wherein said adjustable means comprises spring means.

19. The unit of claim 12 further comprising a fluid entrance port for said reservoir.

20. The unit of claim 19 wherein said housing is generally cylindrical and includes a sidewall on which said fluid entrance port is located.

21. The unit of claim 19 further comprising a stopper for said fluid entrance port.

22. The unit of claim 21 further comprising means for connecting said stopper to said housing.

* * * * *